United States Patent [19]

Mercer

[11] 3,989,054

[45] Nov. 2, 1976

[54] DISHWASHER SYSTEM

[75] Inventor: Robert L. Mercer, Dayton, Ohio

[73] Assignee: General Motors Corporation, Detroit, Mich.

[22] Filed: Oct. 28, 1975

[21] Appl. No.: 626,035

[52] U.S. Cl. ..... 134/104; 134/176

[51] Int. Cl.[2] ..... B08B 3/02

[58] Field of Search ..... 134/104, 176, 186, 191

[56] References Cited

UNITED STATES PATENTS

| | | | |
|---|---|---|---|
| 2,657,695 | 11/1953 | Walker | 134/186 X |
| 3,077,200 | 2/1963 | Guth | 134/176 |
| 3,090,391 | 5/1963 | Kaldenberg et al. | 134/104 |
| 3,126,025 | 3/1964 | Aubert et al. | 134/191 X |
| 3,129,711 | 4/1964 | Schmitt-Matzen | 134/104 X |
| 3,491,780 | 1/1970 | Kaldenberg | 134/104 |
| 3,542,594 | 11/1970 | Smith et al. | 134/104 UX |
| 3,575,185 | 4/1971 | Barbulesco | 134/104 |
| 3,810,480 | 5/1974 | Smith et al. | 134/104 |

*Primary Examiner*—Robert L. Bleutge
*Attorney, Agent, or Firm*—Frederick M. Ritchie

[57] ABSTRACT

A dishwasher has upper and lower spray arms, a telescoping spray tower and a filtering system which includes a frusto-conical screen cage, the outside of which connects to a dishwasher sump by way of a tangential channel including a drain opening therefrom. The inside of the cage connects to the inlet of a double outlet, centrifugal, recirculation pump. Particulates are filtered from recirculating dishwashing fluid on the outside of the screen as the fluid swirls around the cage in a clockwise direction. The tangential approach of the fluid sets up centrifugal forces as an aid in removing filtered particulates from the outside of the screen. A backwash spray rotates in a counterclockwise direction on the inside of the cage to keep the particulates from sticking to the screen. The pump volute is divided into two predetermined volumes rotated with respect to one another to produce two distinct cutoff points and outlets. One outlet supplies the spray arms and tower while the other outlet supplies the backwash spray.

4 Claims, 13 Drawing Figures

DISHWASHER SYSTEM

This invention relates to a domestic dishwasher and, more particularly, to an improved water distribution system therefor.

The prior art includes dishwashers with a variety of water distribution systems, one of which includes a dishwashing chamber with rotatable upper and lower spray arms and a reversible pump for supplying filtered wash and rinse water to the spray arms. During a dishwashing cycle, water is drawn through a generally circular filter to strain sediment from the water prior to its recirculation to the spray arms. A rotatable backwash spray inside the filter back-flushes sediment from the filter. When the pump is reversed, the back-flushed sediment is pumped to drain along with the soiled wash water from the dishwashing chamber. This invention is directed to an improved version of such a filtered water distribution system.

In general, the improved water distribution system of this invention has a filtering system which includes a frustoconical screen cage, the outside of which connects to a dishwasher sump and drain and the inside of which connects to an improved spray tower inside a dishwasher chamber. Particulates flushed from dishes by the spray tower are filtered from recirculating dishwashing fluid onto the outside of the screen. A backwashing spray rotates inside the screen cage to keep the particulates from sticking to the screen. Water from the dishwasher sump approaches the outside of the screen cage on a tangent to set up centrifugal forces as an aid in removing filtered particulates from the outside of the screen.

The water distribution system also includes a double outlet, centrifugal, recirculation pump. The double outlet is provided by dividing the pump volute into two predetermined volumes rotated with respect to one another to produce two distinct cutoff points and outlets. One outlet supplies the wash arms and tower while the other outlet supplies the backwash spray. A drain pump is included and has a common drive shaft with the recirculation pump and an inlet connected to the drain from the dishwasher.

Accordingly, it is an object of this invention to provide a domestic dishwasher with an improved water distribution system.

A further object of this invention is the provision in a dishwasher of an improved water distribution system including a dishwashing chamber having a sump and drain, a pair of spray arms in the chamber, a pump for pumping water from the sump to the spray arms, a filter between the sump and the spray arms for collecting sediment from the pumped water, and a backwash spray inside the filter for removing the collected sediment from the filter, wherein the sump is square and the filter is round and the sump is connected to the filter by a tangential channel so that water approaching the filter from the sump will swirl around the filter as an aid in removing the collected sediment from the filter.

A further object of this invention is the provision of an improved spray tower which includes a single slot in the top thereof having a straight slot spray section and a tapered slot nozzle section to insure proper water coverage throughout the upper rack by providing a single fan-shaped spray having a radial jet portion of relatively high volume and low velocity for coverage (spray section) and a relatively high velocity radial jet portion for impingement on items in the corners of the upper rack (nozzle section).

A still further object is the provision in such an improved water distribution system of a double outlet, centrifugal pump having a single impeller operating in a pump volute divided into two predetermined volumes rotated with respect to each other to provide two distinct cutoff points leading respectively to each of the two outlets.

Further objects and advantages of the present invention will be apparent from the following description, reference being had to the accompanying drawings wherein a preferred embodiment of the present invention is clearly shown.

Figure 4:
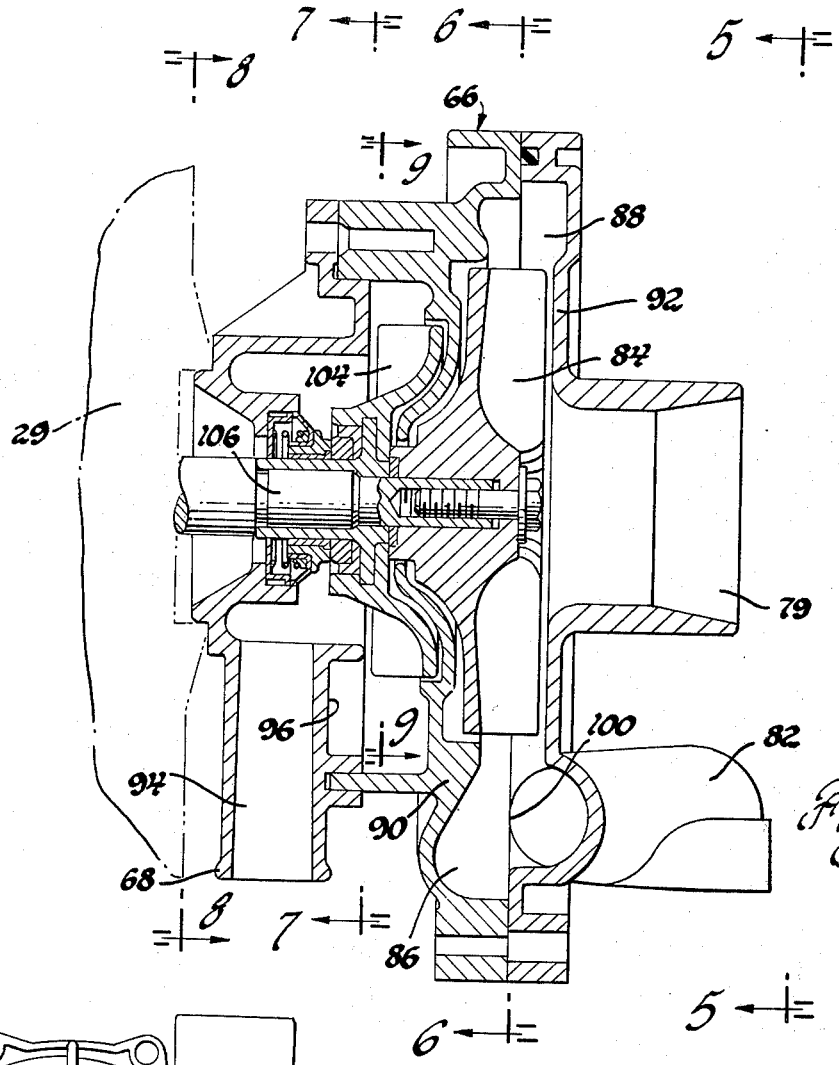
FIG. 4 is a sectional view of the double outlet pump for the water distribution system of this invention.
Figure 5:
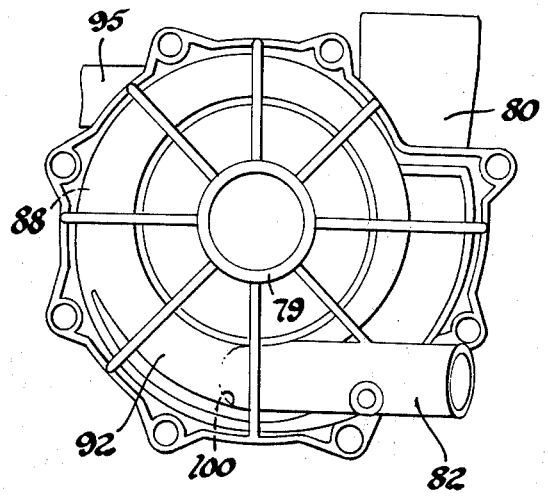
FIG. 5 is a side elevational view of the pump taken along line 5 — 5 in FIG. 4.
Figure 6:
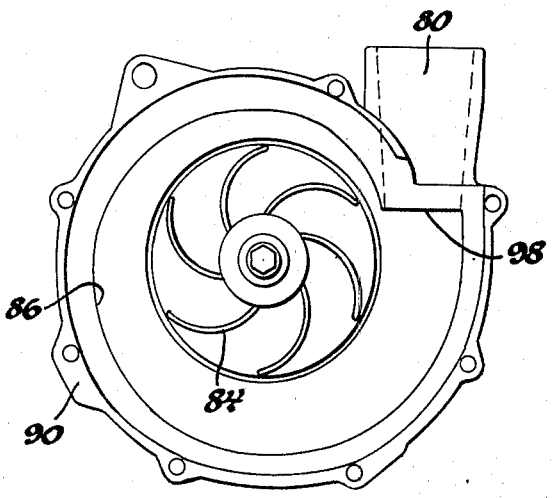
Figure 7:
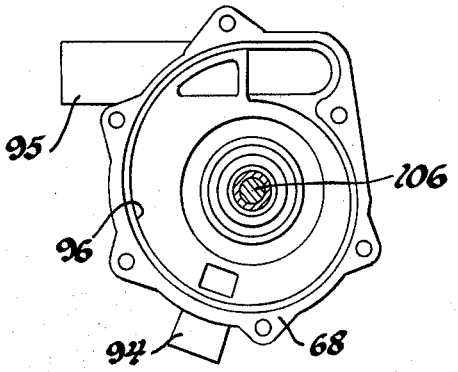
Figure 8:
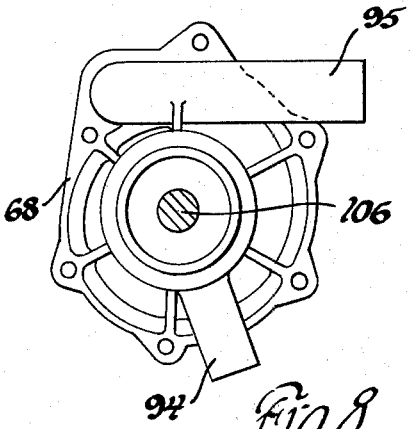
Figure 9:
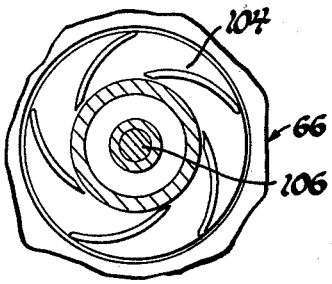
Figure 10:
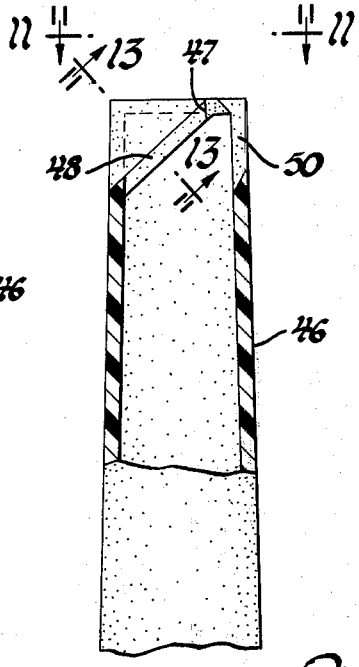
Figure 12:
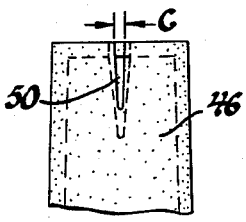
Figure 11:
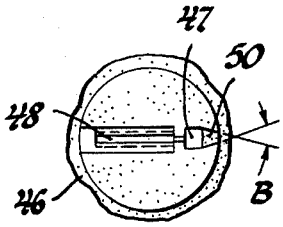

FIGS. 6, 7, 8 and 9 are sectional views of the pump taken respectively along lines 6 — 6, 7 — 7, 8 — 8, and 9 — 9 in FIG. 4;

FIG. 10 is a sectional view partly in elevation of the improved spray tower of this invention;

FIG. 11 is a top elevational view of the spray tower showing the two sections of the single port and taken along line 11 — 11 in FIG. 10;

FIG. 12 is a side elevational view of one of the port sections; and

Figure 13:
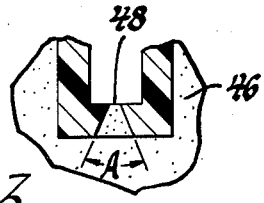

FIG. 13 is a sectional view taken along line 13 — 13 of FIG. 10 to show the other port section.

GENERAL

Figure 1:
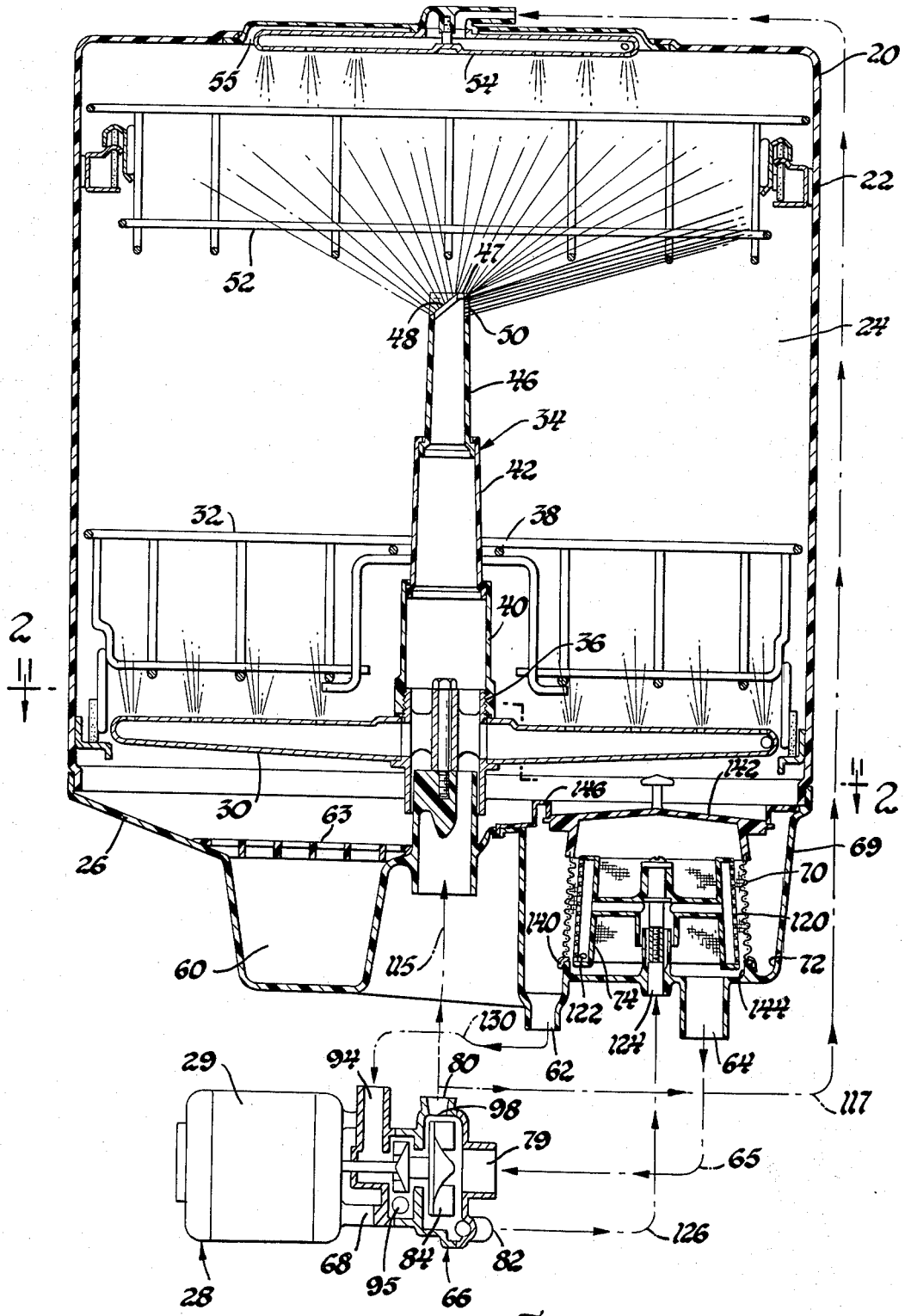
FIG. 1 is a sectional view partly in elevation showing schematically the water distribution system of this invention.
Figure 2:
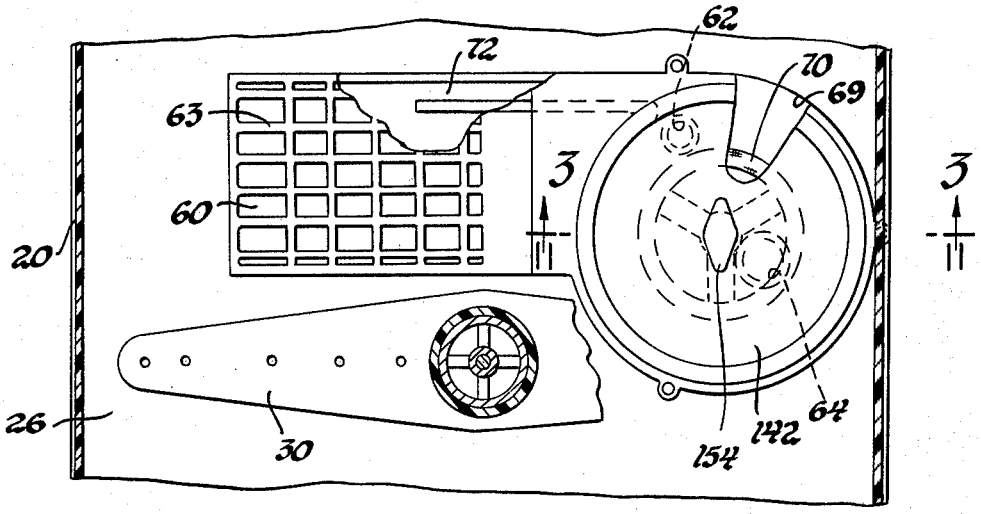
FIG. 2 is a fragmentary top elevational view, partly in section and partly broken away, taken along line 2 — 2 in FIG. 1 to show the filter and the bottom of the dishwashing chamber.

In accordance with this invention and with reference to FIGS. 1 and 2, an improved dishwasher 20 is illustrated generally. The dishwasher 20 is comprised of plastic casing means 22 defining a dishwashing chamber or tub 24 closed at the front thereof by a dishwasher door (not shown) and a molded bottom 26 leading to a pump and motor assembly 28.

In general, and with reference to FIG. 1, the improved water distribution system of this invention includes a revoluble, horizontal spray arm or fluid discharge device 30 adapted for operation beneath a lower rack 32 and a rotating spray column or spray tower 34 affixed at 36 to the spray arm and extendable upwardly through a guard portion 38 of the lower rack. The spray tower 34 is comprised of three telescoping sections 40, 42, and 46, the upper two of which pop up through rack 32 when the pump is operating to distribute water or washing fluid in the dishwashing chamber. Section 40 is threadedly affixed at 36 to the lower spray arm 30 and houses sections 42 and 46 in nested fashion when the pump is not operating. The top section 46 includes a single port 47 having a pair of port sections 48, 50 — to be described more fully hereinafter. The port sections combine to direct a single fan-shaped spray of varying cross section over the bottom of an upper rack 52.

A second spray arm or fluid discharge device 54 is rotatably mounted in a top recess 55 of the dishwashing chamber 24 to spray downwardly on top of the upper rack 52.

The bottom 26 of the chamber defines a sump to catch water that has been sprayed over the dishes. The sump forms a square basin portion 60 and a round filter portion 69 which are in communication with either of two outlets 62, 64 from the chamber. A removable grate 63 covers the basin to keep silverware or the like from getting lost. Conduit 65 connects outlet 64 to a recirculation pump portion 66 of assembly 28 and conduit 130 connects outlet 62 to the drain pump portion 68 thereof. Both pump portions are driven by a reversible motor 29. The recirculation pump portion 66 is effective when the motor operates in one direction and the drain pump portion 68 is effective when the motor is reversed.

A frusto-conical screen filter 70 is interposed between the square cavity of basin 60 and outlet 64 and forms a screen cage over the outlet 64 to trap particulates in the water being recirculated. The soiled water approaches the filter along a tangential passageway or channel 72 leading to the round or circular housing 69 for filter 70. A clockwise swirling action is induced by the tangential approach of the water and the descending terminal portion of the channel leading to drain outlet 62. Such swirling aids in keeping heavy sediment along the walls of housing 69 by centrifugal force to minimize clogging of the screen. Inside the filter is a backwash spray device 74 which also receives its supply of backwash water from the recirculation pump portion 66. The backwash spray rotates counterclockwise and tends to flush the collected sediment from the screen. Aiding in this backwash is the clockwise swirling action of water from tangential channel 72 which tends, by the turbulence thereof, to strip the collected sediment from the screen.

THE PUMP AND MOTOR ASSEMBLY

The pump and motor assembly 28 includes a recirculation pump portion 66, a drain pump portion 68, and a reversible motor 29 to drive both pump portions (FIGS. 4 – 9).

The recirculation pump portion 66 is used for washing and rinsing the dishes in racks 32, 52, and for backwashing filter 70. It is a centrifugal type pump having an inlet 79, a primary outlet 80 and a secondary outlet 82. The pump is unique in that both its outlets 80, 82 are supplied by a single impeller 84. The pump volute has been divided into two predetermined volute-shaped volumes 86, 88 defined and configured by housing halves 90, 92. These housing halves are rotated with respect to each other sufficiently (FIG. 5) to produce two distinct cutoff points 98, 100 leading respectively to the two outlets 80, 82.

The drain pump portion 68 has a drain inlet 94 and a drain outlet 95 interconnected by a volute 96. A drain impeller 104 is mounted on the same shaft 106 that mounts the recirculation impeller 84. Thus, impeller 84 recirculates wash or rinse water through the filter 70 when reversible motor 29 is energized for operation in one direction and impeller 104 pumps soiled wash or rinse water to drain when the motor is reversed.

THE SPRAY TOWER

The top of spray tower section 46 has a specially designed port 47 for providing a single fan-shaped spray. Port 47 is comprised of a coverage port section 48 and a nozzle port section 50. Each port section 48, 50 converges (FIGS. 11 and 13) as it passes through the wall thickness of the spray tower, port section 48 by an angle A of 45° and port section 50 by an angle of 30°. However, the outer opening of port section 48 is straight along its length whereas the outer opening of port section 50 tapers symmetrically along the side of the spray tower by an angle C of 2°. This taper gives port section 50 a nozzle configuration. Thus, the fan-shaped spray effected by port 47 will have a relatively high volume, low velocity, thin film spray segment essentially covering all areas of the upper rack plus a relatively high velocity, thickened jet spray segment adapted to hit the downwardly facing openings of tall glasses in the corners of the upper rack with such concentrated force that the jet spray segment will carry up to the bottom of the glass for thoroughly cleansing the interior thereof. Straight port section 48 produces the thin film spray segment and tapered port section 50 produces the thickened jet spray segment.

WATER DISTRIBUTION SYSTEM

Light and heavy soil is removed from dishes in racks 32, 52 by recirculating wash and rinse water to dishwashing chamber 24. For this purpose, pump portion 66 has its primary outlet 80 connected by T-fitted hoses 115, 117 leading to spray arms 30 and 54. Spray tower 34 receives its water from spray arm 30 and pops up to the position in FIG. 1 in response thereto.

During recirculation and with reference to FIG. 1, wash water which has been discharged over the dishes falls by gravity into basin 60 along with the soil flushed from the dishes. From basin 60 the soiled water collected then flows into the filter housing 69 along a channel 72 which is tangent to the circumference of the housing and also descends toward drain outlet 62. The centrifugal force produced by the swirling action of the water urges the heavy soil toward the outer wall of the housing as it moves toward the drain, thereby minimizing the deposit of heavy soil on the outside of filter screen 70. The lighter soil which is deposited on filter 70 as soiled water is drawn through the screen is backwashed with high pressure water jetting from ports 120 in backwash spray 74 as it rotates in response to a reaction port 122. Water is supplied to the backwash spray 74 through an inlet 124 in the filter housing which is connected by a hose 126 to the secondary outlet 82 of pump portion 66. The light soil backwashed from the filter 70 together with the centrifugally separated heavy soil is then pumped to a remote drain through drain outlet 62 which is connected to the inlet 94 of the drain pump by a hose 130.

Figure 3:
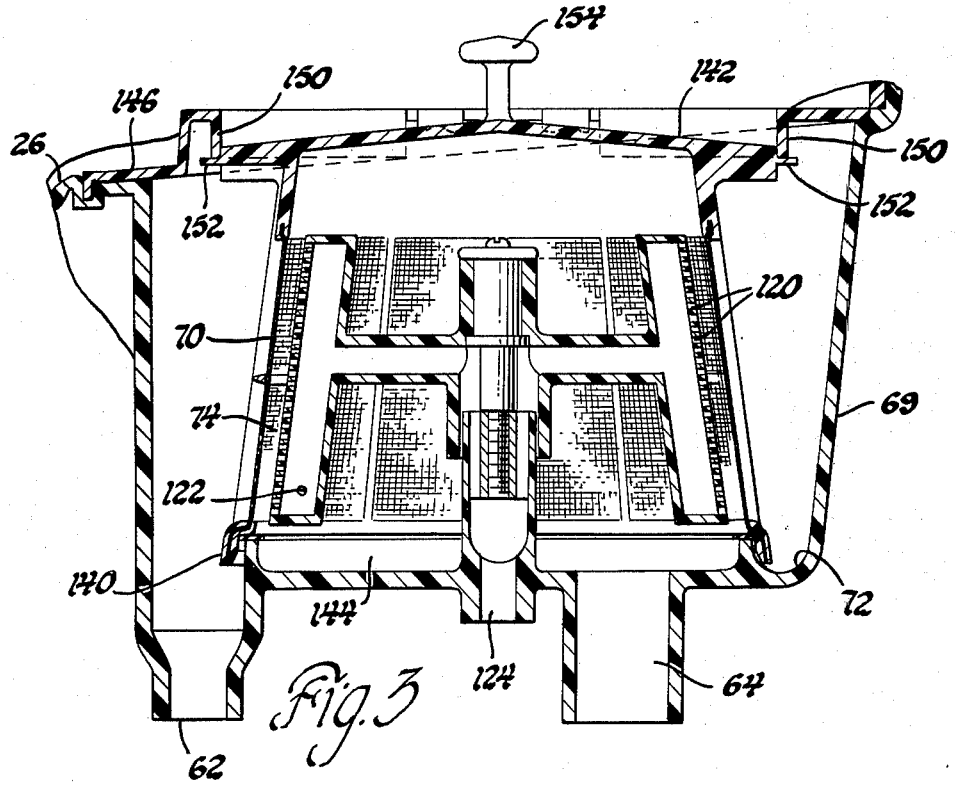
FIG. 3 is a fragmentary sectional view, partly in elevation, taken along line 3 — 3 in FIG. 2.

Periodically, one may wish to inspect the filter 70 for the purpose of cleaning it manually or replacing it. To facilitate this, the filter screen is molded into a plastic frame having a bottom ring 140 and top cover 142 (FIG. 3). Bottom ring 140 rests in watertight relationship to a raised complementary ring 144 on the bottom of the filter housing 69. A filter retaining ring 146 is fastened to overlie a portion of the bottom wall 26 of the dishwasher. The ring covers the tangential channel 72 up to the grate 60 and provides latching shoulders 150 for tangs 152 on the cover 142. The filter is removed by grasping cover handle 154 and rotating the entire filter until the tangs clear the shoulders. Then the filter is lifted from the filter housing for cleaning or replacement.

While the embodiment of the present invention as herein disclosed constitutes a preferred form, it is to be understood that other forms might be adopted.

What is claimed is:

1. In a dishwasher having a washing period and a draining period, the combination comprising: a washing chamber, a fluid discharge device for introducing washing fluids into said chamber, wall means forming a sump having a pair of filter portions for receiving the washing fluids from said chamber, one of said filter portions communicating directly with said washing chamber and connecting directly with the other of said filter portions along a tangent to the circumference thereof whereby said other filter portion communicates indirectly with said washing chamber through said one filter portion, a recirculation pump having a single impeller and a pump volute divided into two predetermined volumes forming a pair of supply openings, a discharge conduit connected from said other filter portion to said recirculation pump for returning washing fluids to said recirculation pump, supply conduit means connected to one of the supply openings of said recirculation pump for supplying washing fluids from said recirculation pump to said fluid discharge device, a self-cleaning filter means including a vertically oriented strainer within said other filter portion between the tangential connection of said filter portions and said discharge conduit in the path of the recirculated washing fluids, said wall means forming the other filter portion of said sump including means forming a sufficiently wide and descending trough around the upstream side of said strainer to induce a swirl to washing fluids entering said other filter portion from said one filter portion through said tangential connection, whereby light soil particles may be collected on the upstream side of said strainer while heavy soil particles are centrifugally forced away from the upstream side of said strainer to remain in said trough outboard of said strainer, a drain opening in said trough at the opposite end thereof from said tangential connection, a shaft member coaxially disposed relative to said strainer, a revoluble spray device inside said strainer mounted on said shaft member for projecting fluids against the downstream side of said strainer for backwashing into said trough the light soil particles which have been collected, a spray conduit connecting the other of said supply openings of said recirculation pump for supplying washing fluids from said recirculation pump to said spray device during said washing and drain periods, a drain conduit connected to the drain opening in said trough for conducting light and heavy soil particles from said trough to drain during said draining period, and a cover member forming a closed top for said other filter portion and integral with said strainer, said cover member having means for removably retaining said cover on the wall means of said sump whereby said strainer may be removed from said sump for inspection.

2. In a dishwasher having a washing period and a draining period, the combination comprising: a washing chamber, top and bottom fluid discharge devices for introducing washing fluids into said chamber, wall means forming a sump having square and round filter portions for receiving the washing fluids from said chamber, said square filter portion communicating by means of a removable grate directly with said washing chamber and connecting directly to said round filter portion along a tangent to the circumference thereof whereby said round filter portion communicates indirectly with said washing chamber through said square filter portion, a recirculation pump having a single impeller and a pump volute divided into two predetermined volumes rotated with respect to each other to form a pair of supply openings, a discharge conduit connected from said round filter portion to said recirculation pump for returning washing fluids to said recirculation pump, supply conduit means connected to one of the supply openings of said recirculation pump for supplying washing fluids from said recirculation pump to both of said fluid dishcarge devices, a self-cleaning filter means including a vertically oriented frustoconical strainer within said round filter portion between the tangential connection of said square and round filter portions and said discharge conduit in the path of the recirculated washing fluids, said wall means forming the round filter portion of said sump including means forming a sufficiently wide and descending trough around the upstream side of said strainer to induce a swirl to washing fluids entering said round filter portion from said square filter portion through said tangential connection, whereby light soil particles may be collected on the upstream side of said strainer while heavy soil particles are centrifugally forced away from the upstream side of said strainer to remain in said trough outboard of said strainer, a drain opening in said trough at the opposite end thereof from said tangential connection, a shaft member coaxially disposed relative to said strainer, a revoluble spray device inside said strainer mounted on said shaft member for projecting fluids against the downstream side of said strainer for backwashing into said trough the light soil particles which have been collected, a spray conduit connecting the other of said supply openings of said recirculation pump for supplying washing fluids from said recirculation pump to said spray device during said washing and drain periods, a drain conduit connected to the drain opening in said trough for conducting light and heavy soil particles from said trough to drain during said draining period, and a cover member forming a closed top for said round filter portion and integral with said strainer, said cover member having means for removably retaining said cover on the wall means of said sump whereby said strainer may be removed from said sump for inspection.

3. In a dishwasher having a washing period and a draining period, the combination comprising: a washing chamber rectangular in horizontal cross section and including upper and lower racks of like rectangular horizontal expanse, top and bottom fluid discharge devices for introducing washing fluids into said chamber, said top fluid discharge device adapted for spraying washing fluid over the top of said upper rack, said bottom fluid dishcarge device including a spray tower with an upper end between said upper and lower racks and having a slot in the top thereof adapted for spraying washing fluid over the bottom of said upper rack, said slot comprising a straight slot section to provide a relatively low velocity fan-shaped spray of fluid coextensively covering the bottom of said upper rack throughout the rectangular horizontal expanse thereof for flushing soil particles from the exterior of dishes and glasses located throughout said upper rack and a tapered slot section to provide a relatively high velocity jet of fluid impinging on the bottom corners of said upper rack for flushing soil particles from the interior of dishes and glasses located in the corners of said upper rack, wall means forming a sump having square and round filter portions for receiving the washing fluids and soil particulates from dishes being washed in said chamber, said square filter portion communicating by means of a removable grate directly with said washing chamber and connecting directly to said round filter portion along a tangent to the circumference thereof whereby said round filter portion communicates indirectly with said washing chamber through said square filter portion, a recirculation pump having a single impeller and a pump volute divided into two predetermined volumes rotated with respect to each other to form a pair of supply openings, a discharge conduit connected from said round filter portion to said recirculation pump for returning washing fluids to said recirculation pump, supply conduit means connected to one of the supply openings of said recirculation pump for supplying washing fluids from said recirculation pump to both of said fluid discharge devices, a self-cleaning filter means including a vertically oriented frusto-conical strainer within said round filter portion between the tangential connection of said square and round filter portions and said discharge conduit in the path of the recirculated washing fluids, said wall means forming the round filter portion of said sump including means forming a sufficiently wide and descending trough around the upstream side of said strainer to induce a swirl to washing fluids entering said round filter portion from said square filter portion through said tangential connection, whereby light soil particles may be collected on the upstream side of said strainer while heavy soil particles are centrifugally forced away from the upstream side of said strainer to remain in said trough outboard of said strainer, a drain opening in said trough at the opposite end thereof from said tangential connection, a shaft member coaxially disposed relative to said strainer, a revoluble spray device inside said strainer mounted on said shaft member for projecting fluids against the downstream side of said strainer for backwashing into said trough the light soil particles which have been collected, a spray conduit connecting the other of said supply openings of said recirculation pump for supplying washing fluids from said recirculation pump to said spray device during said washing and drain periods, a drain conduit connected to the drain opening in said trough for conducting light and heavy soil particles from said trough to drain during said draining period, and a cover member forming a closed top for said round filter portion and integral with said strainer; said cover member having means for removably retaining said cover on the wall means of said sump whereby said strainer may be removed from said sump for inspection.

4. The dishwasher of claim 3 wherein said spray tower is comprised of three sections, two sections of which normally telescopingly nest in the third section, said two sections adapted to pop upwardly out of said third section as a telescoping extension thereof when the recirculation pump supplies washing fluid to the bottom fluid discharge device.

* * * * *